US005402762A

United States Patent [19]

Yamada et al.

[11] Patent Number: 5,402,762

[45] Date of Patent: Apr. 4, 1995

[54] COMBUSTION ENGINE AND COMBUSTION ENGINE CONTROL METHOD

[75] Inventors: Masakazu Yamada, Nagoya; Masakazu Ninomiya, Kariya; Yasuo Sagisaka, Anjo, all of Japan

[73] Assignee: Nippondenso Co., Ltd., Kariya, Japan

[21] Appl. No.: 101,689

[22] Filed: Aug. 4, 1993

[30] Foreign Application Priority Data

Sep. 9, 1992 [JP] Japan ..... 4-240765
May 26, 1993 [JP] Japan ..... 5-124168

[51] Int. Cl.[6] ..... F02D 43/00
[52] U.S. Cl. ..... 123/478; 123/198.05
[58] Field of Search ..... 123/478, 480, 490, 198 DB, 123/DIG. 11

[56] References Cited

U.S. PATENT DOCUMENTS 4,111,175 9/1978 Nakamura et al. ..... 123/DIG. 11
4,768,480 9/1988 Grenn et al. ..... 123/198 DB
5,062,400 11/1991 Minegishi ..... 123/DIG. 11

FOREIGN PATENT DOCUMENTS 60-53638 3/1985 Japan .
3242466 10/1991 Japan .
4153558 5/1992 Japan .

*Primary Examiner*—Raymond A. Nelli
*Assistant Examiner*—Thomas N. Moulis
*Attorney, Agent, or Firm*—Cushman, Darby & Cushman

[57] ABSTRACT

In a combustion engine control, an amount of fuel suitable for each combustion cycle in the combustion engine is determined, the fuel is injected into the combustion engine, a spark for igniting the injected fuel is generated in the combustion engine, it is detected that the combustion engine is ordered to be stopped, the combustion engine is stopped by preventing to start injecting the fuel into the combustion engine after it is detected that the combustion engine is ordered to be stopped, the determined amount of fuel completes being injected into the combustion engine after the fuel starts to be injected into the combustion engine, regardless of whether it is detected that the combustion engine is ordered to be stopped.

26 Claims, 7 Drawing Sheets

COMBUSTION ENGINE AND COMBUSTION ENGINE CONTROL METHOD

BACKGROUND OF THE INVENTION AND RELATED ART STATEMENT

The present invention relates to a combustion engine and combustion engine control method, according to which a combustion condition in the engine is appropriately controlled after the combustion engine is ordered to be stopped.

In a prior-art combustion engine control method as disclosed by Publication of Japanese Unexamined Patent Application Hei-3-242466, a fuel injection is prevented just after an ignition switch is operated to stop the engine, and an ignition is continued until a predetermined time elapses thereafter.

OBJECT AND SUMMARY OF THE INVENTION

An object of the present invention is to provide a combustion engine and combustion engine control method, in which a misfire is prevented after an ignition switch is operated to stop the engine.

According to the present invention, a combustion engine comprises, a determining means for determining an amount of fuel suitable for each combustion cycle in the combustion engine, a fuel injecting means for injecting the fuel into the combustion engine, an ignition means for igniting the injected fuel in the combustion engine, and a detecting means for detecting that the combustion engine is ordered to be stopped, wherein the fuel injecting means prevents to start injecting the fuel after the detecting means detects that the combustion engine is ordered to be stopped, and, after the fuel injecting means starts to inject the fuel, the fuel injecting means completes injecting the determined amount of fuel into the combustion engine regardless of whether the detecting means detects that the combustion engine is ordered to be stopped.

According to the present invention, a combustion engine control method comprises, the steps of:

determining an amount of fuel suitable for each combustion cycle in the combustion engine, injecting the fuel into the combustion engine, igniting the injected fuel in the combustion engine, and detecting that the combustion engine is ordered to be stopped, and stopping the combustion engine by preventing to start injecting the fuel after the detecting means detects that the combustion engine is ordered to be stopped, wherein, after the fuel injecting means starts to inject the fuel, the fuel injecting means completes injecting the determined amount of fuel into the combustion engine regardless of whether the detecting means detects that the combustion engine is ordered to be stopped.

According to the present invention, since the fuel injecting means completes injecting the determined amount of fuel into the combustion engine after the fuel injecting means starts to inject the fuel, regardless of whether the detecting means detects that the combustion engine is ordered to be stopped, the fuel injecting means is prevented from injecting only a part of the determined amount of fuel into the combustion engine for the combustion cycle in response to detecting that the combustion engine is ordered to be stopped, so that the determined amount of fuel suitable for each combustion cycle is completely injected into the combustion engine even when the detecting means detects that the combustion engine is ordered to be stopped. Therefore, a misfire of injected fuel caused by an excessively lean fuel/air mixture formed by the part of the determined amount of fuel is securely prevented, so that an unburned injected fuel is prevented from remaining in the combustion engine and from being discharged from the combustion engine.

The determined amount of fuel suitable for each combustion cycle may be substantially equal to or more than a lower limit amount of fuel for forming an ultimate lean fuel/air mixture for preventing a misfire in the combustion cycle, or may be substantially equal to an optimum amount of fuel for forming a fuel/air mixture to perform a desirable or complete combustion condition in the combustion cycle.

The amount of fuel suitable for each combustion cycle may be determined before the fuel starts to be injected into the combustion engine, may be determined while the fuel is being injected into the combustion engine, or may be determined after the fuel starts to be injected into the combustion engine.

A further amount of fuel for each combustion cycle may be injected into the combustion engine in addition to the determined amount of fuel into the combustion engine by keeping to inject the fuel continuously after the determined amount of fuel has been injected into the combustion engine, when the determined amount of fuel is substantially equal to or slightly more than a lower limit amount of fuel for forming an ultimate lean fuel/air mixture for preventing a misfire, or when the determined amount of fuel is significantly less than an upper limit amount of fuel for forming an ultimate rich fuel/air mixture for preventing a misfire, so that a desirable engine output and/or a desirable exhaust contaminant density can be performed by an optimum fuel/air ratio.

Alternatively, the fuel may be prevented from being injected into the combustion engine, in response to that the determined amount of fuel completes being injected into the combustion engine, or in response to that the determined amount of fuel completes being injected into the combustion engine on and after detecting that the combustion engine is ordered to be stopped.

The spark may continue to be generated in the combustion engine, at least until the fuel finally injected into the combustion engine is ignited by the spark, after the fuel finally injected into the combustion engine is ignited by the spark, at least until a predetermined time elapses after it is detected that the combustion engine is ordered to be stopped, or at least until the combustion engine is substantially stopped.

DETAILED DESCRIPTION OF PREFERRED EMBODIMENTS

Figure 1:
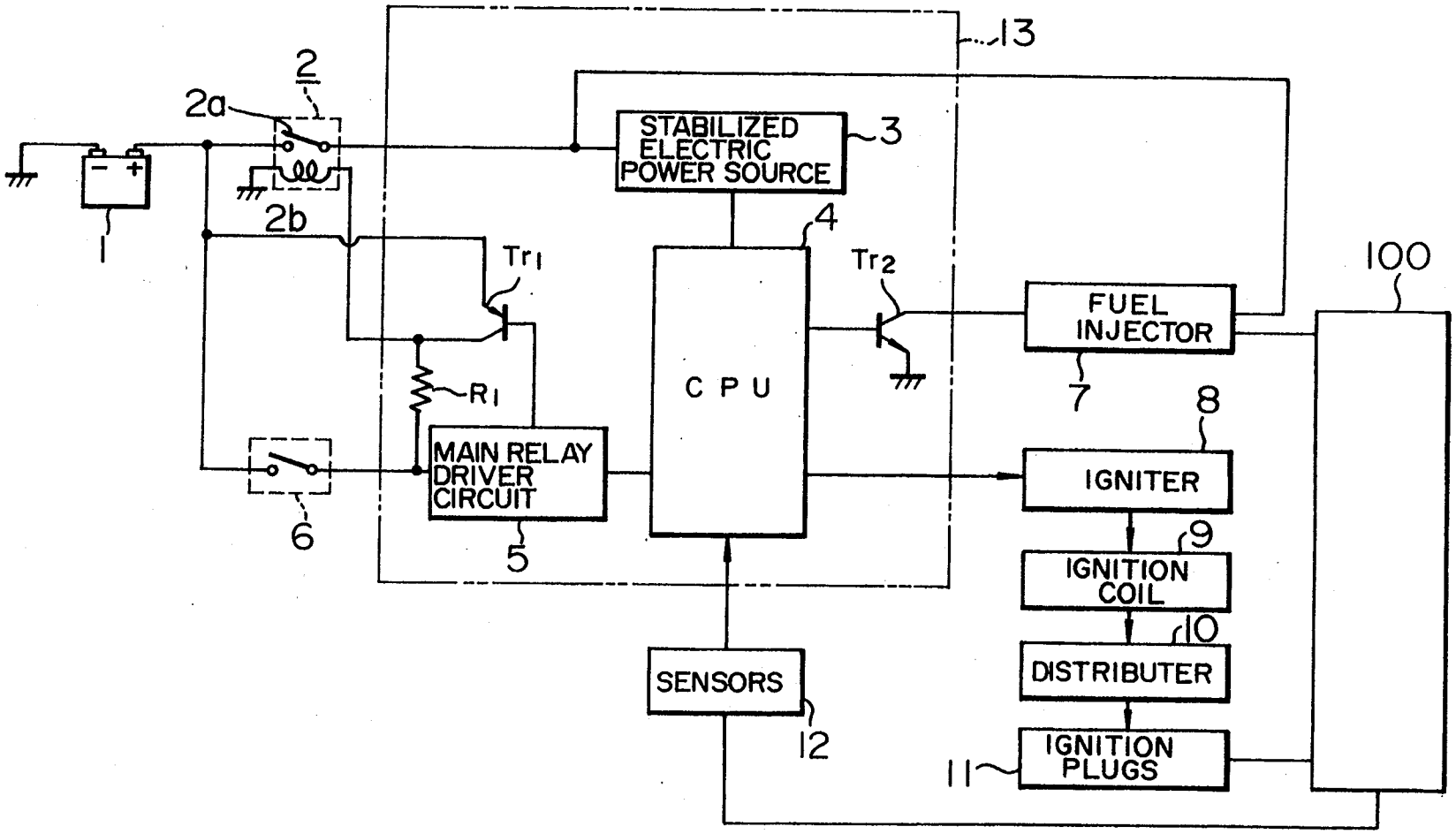
FIG. 1 is a schematic view showing a combustion engine operation apparatus including an ignition device, a fuel injection device and a control unit therefor.

As shown in FIG. 1, an electric battery 1 supplies an electricity to a central processing unit (CPU) 4 through a main relay 2 whose switch 2*a* is closed to allow the electricity to pass therethrough when a coil 2*b* is electrically energized, and through a stabilized electric power source circuit 3. An electrical energizing of the coil 2*b* is switched on and off by an ignition switch 6 through an electric resistance R1, and by a transistor Tr1 which is electrically activated to allow the electricity from the electric battery 1 to pass therethrough by a main relay driver circuit 5 even after the ignition switch 6 is opened to prevent the electricity to pass therethrough. The main relay driver circuit 5 outputs to the CPU 4 a signal showing whether the ignition switch 6 is opened or closed, so that the CPU 4 knows as to whether a combustion engine 100 is ordered to be stopped or not and energizes electrically the coil 2*b* through the main relay driver circuit 5 and the transistor Tr1, on and after the ignition switch 6 is opened to order the combustion engine 100 to be stopped. The electrical energizing of the coil 2*b* is maintained by the CPU 4, until completing each of the below mentioned controls, or for a predetermined time sufficient for carrying out the below mentioned controls, after the ignition switch 6 is opened to order the combustion engine 100 to be stopped.

The ignition switch 6 includes a starter motor switch (not shown) for activating a starter motor (not shown) to drive a crank shaft (not shown) of the combustion engine 100. When the ignition switch 6 is closed by an operator, the ignition switch 6 firstly energizes the coil 2*b* to supply the electricity from the battery 1 to the CPU 4, and secondly activates the starter motor for starting an combustion of the combustion engine 100. According to a rotation of the crank shaft, the CPU 4 controls a fuel injection and an ignition in the combustion engine 100.

The electricity is supplied from the electric battery 1 to the fuel injector 7 through the main relay 2 and a transistor Trs to inject a fuel into the combustion engine 100, when the switch 2*a* is closed and the transistor Trs is electrically activated by the CPU 4, so that the CPU 4 controls a fuel injection of the fuel injector 7 through the transistor Tr2. The CPU 4 controls an electrical energizing of an ignition coil device 9 through an ignitor 8, and the ignition coil device 9 is connected to ignition spark plugs 11 (one of them is shown in FIG. 1) through a distributer 10 to distribute an ignition electric current from the ignition coil device 9 among the ignition spark plugs 11 for igniting the injected fuel in respective combustion chambers (not shown) of the combustion engine 100.

The CPU 4 calculates a desirable amount of fuel for an optimum or desirable combustion condition, a lower limit amount of fuel for forming an ultimate lean fuel/air mixture for preventing a misfire in each combustion cycle, and/or an upper limit amount of fuel for forming an ultimate rich fuel/air mixture for preventing the misfire or undesirable exhaust contaminant, to be injected into each of the combustion chambers by the fuel injector 7, and further calculates a desirable or optimum ignition timing of each of the ignition spark plugs 11 and a desirable or optimum fuel injection timing of the fuel injector on the basis of an intake air flow rate, a crank shaft rotational speed, and a crank shaft rotational position and so forth measured by sensors 12. Opening and closing timings of the fuel injector 7, and primary electric current pulse start timing and width energizing the ignition coil device 9 are determined by the CPU 4 on the basis of the calculated amount of fuel and the calculated ignition timing to control the ignition and fuel injection of the combustion engine 100. An electric control device 13 is composed of the stabilized electric power source circuit 3, the CPU 4, the electric resistance R1, and the transistors Tr1, Tr2.

Figure 2:
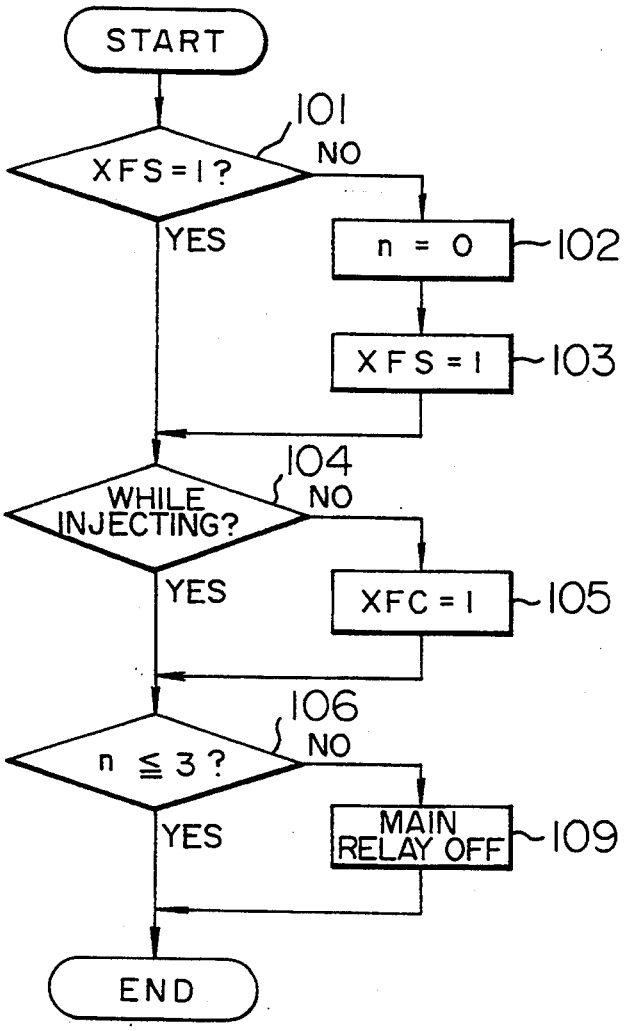
FIG. 2 is a flow chart showing an embodiment of the present invention control of a fuel injection operation and an igniting operation for the injected fuel.

A fuel injection and ignition control shown in FIG. 2 for applying to the combustion engine with four cycle combustion and four combustion chambers is started immediately after the CPU detects that the ignition switch 6 has been opened to order the combustion engine 100 to be stopped, and is repeated at intervals of, for example, approximately 10 milliseconds thereafter. An ignition stop notice flag XFS and a fuel injection preventing flag XFC are set "0" just after the ignition switch 6 is closed to activate the CPU 4.

At a step 101 of the fuel injection and ignition control shown in FIG. 2, whether the ignition stop notice flag XFS is now "1" or not is judged. On the start of the fuel injection and ignition control, the ignition stop notice flag XFS is "0". Therefore, a step 102 is carried out so that a number "n" of ignition times or combustion chambers in which the respective ignitions are performed after setting the ignition stop notice flag XFS "1" is set "zero", and subsequently a step 103 is carried out to set the ignition stop notice flag XFS "1". When the fuel injection and ignition control is repeated, since the ignition stop notice flag XFS is already set "1", the steps 102 and 103 are not carried out.

Subsequently, whether the injector 7 is being injecting the fuel into the engine or not is judged at a step 104. When the injector 7 is not injecting the fuel, the fuel injection preventing flag XFC is set "1" at a step 5. When the injector 7 is injecting the fuel, a step 106 is carried out directly without passing the step 105. The intervals for repeating the fuel injection and ignition control are sufficiently less than a time between a finish of the fuel injection and a subsequent start thereof, so that the fuel injection preventing flag XFC is securely set "1" when the fuel injection and ignition control is carried out again.

A processing operation relative to an injecting condition of the fuel injector 7 as above described may be carried out prior to a processing operation relative to a condition of the ignition stop notice flag XFS as above described.

At the step 106, whether the number of ignition times "n" is more than 3 or not is judged. When the number of ignition times "n" is not more than 3, the fuel injection and ignition control is repeated after the interval. When the number of ignition times "n" is more than 3, the switch *2a* is opened at a step 109 to prevent the electricity from being supplied to the CPU and the fuel injector 7 so that both the fuel injection and ignition are stopped.

Figure 3:
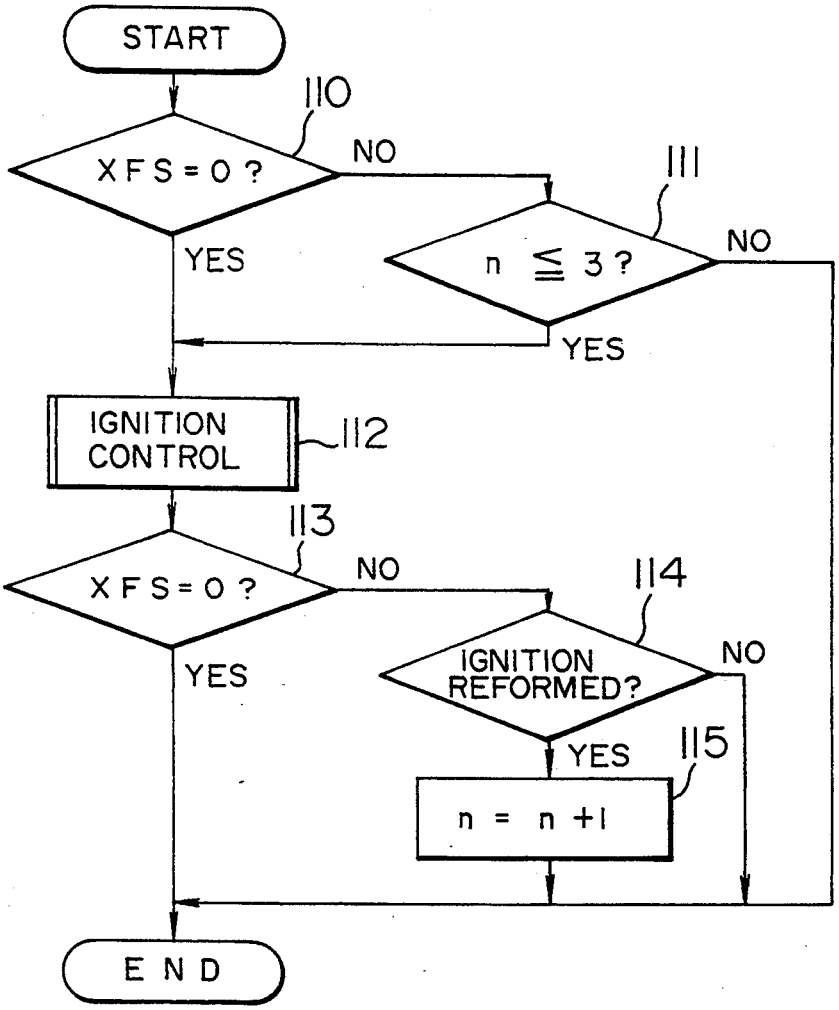
FIG. 3 is a subroutine flow chart for driving the ignition device.

The ignition by each of the spark plugs 11 in the respective combustion chambers is carried out according to an ignition control as shown by FIG. 3. The ignition control for each of the combustion chambers is started in response to an angular position of the rotating crank shaft for the ignition control so that the ignition can be carried out at an appropriate timing in each combustion cycle. When the rotating crank shaft has reached the angular position for the ignition control, whether the ignition stop notice flag XFS is zero or not is judged at a step 110. When the ignition stop notice flag XFS is zero, the spark plug 11 ignites the injected fuel in the combustion engine 100 with the calculated ignition timing at a step 112. When the ignition stop notice flag XFS is not zero, whether the number of ignition times "n" is more than 3 or not is judged at a step 111. When the number of ignition times "n" is not more than 3, the spark plug 11 ignites the injected fuel in the combustion engine 100 with the calculated ignition timing at the step 112. When the number of ignition times "n" is more than 3, the ignition is not done and the ignition control is started again if the rotating crank shaft reaches another subsequent angular position for the ignition control. After the step 112, whether the ignition stop notice flag XFS is zero or not is judged at a step 113. When the ignition stop notice flag XFS is zero, the ignition control is started again if the rotating crank shaft reaches the another subsequent angular position for the ignition control. When the ignition stop notice flag XFS is not zero, whether the ignition is achieved or not is judged at a step 114. When the ignition is not achieved, the ignition control is started again if the rotating crank shaft reaches the another subsequent angular position for the ignition control. When the ignition is achieved, the number of ignition times "n" is increased by 1 at a step 115, and the ignition control is started again if the rotating crank shaft reaches the another subsequent angular position.

Figure 4:
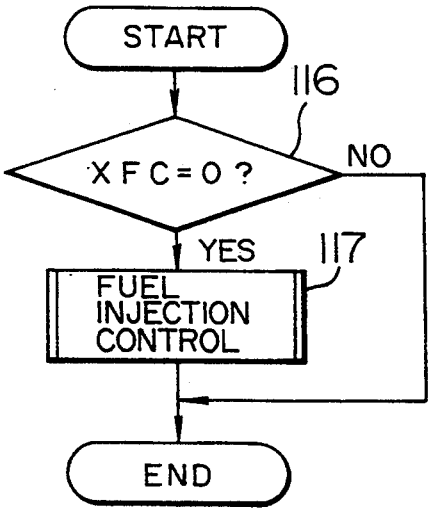
FIG. 4 is a subroutine flow chart for driving the fuel injection device.

The fuel injection by the fuel injector 7 is carried out according to a fuel injection control as shown by FIG. 4. The fuel injection control for each of the combustion chambers is started in response to an angular position of the rotating crank shaft for the fuel injection control so that the fuel injection can be carried out at an appropriate timing in each combustion cycle. At a step 116, whether the fuel injection preventing flag XFC is "0" or not is judged. When the fuel injection preventing flag XFC is not "0", the fuel injection is not done and the fuel injection control is started again if the rotating crank shaft reaches another subsequent angular position of the rotating crank shaft for the fuel injection control. When the fuel injection preventing flag XFC is "0", the fuel injector 7 injects the fuel into the combustion engine 100 with the calculated fuel injection timing at the step 117, and the fuel injection control is started again if the rotating crank shaft reaches another subsequent angular position of the rotating crank shaft for the fuel injection control.

The meanings of abbreviated legends in the FIG. 5 and 8 tables are as follows:

In: intake gas
Exh: exhaust gas
Com: compress gas
Exp: gas expansion while the rectangle stands for fuel injection and the lightening stroke stands for ignition.

Figure 5:
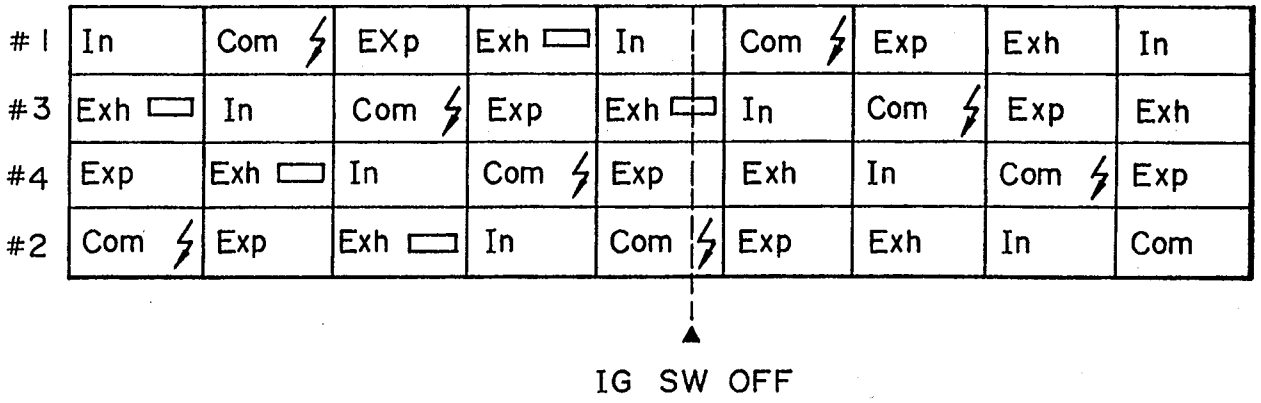
FIG. 5 is a table showing a relation among the fuel injection operation, the igniting operation and combustion cycles proceeding with an engine crank shaft rotation, obtained when the flow chart of FIG. 2 is used.

As shown in FIG. 5, in the present invention's fuel injection and ignition control applied to the four-cycle combustion engine with the four combustion chambers, the fuel injector 7 completes securely the calculated desirable amount of fuel regardless of detecting that the ignition switch 6 has been opened to order the combustion engine 100 to be stopped, and the spark plug 11 generates an ignition spark at least once in each of the combustion chambers after detecting that the ignition switch 6 has been opened to order the combustion engine 100 to be stopped. Each combustion cycle is composed of an air intake step, a compression step, an expansion step and an exhaust step, which steps occur substantially every 180 degrees rotation of the crank shaft. The fuel injector 7 starts injecting the fuel into the combustion engine 100 in the latter half of the exhaust step, and a mixture of the injected fuel and an intake air flows into the combustion chamber in the air intake step. The fuel is ignited just before a terminating end of the compression step.

Figure 6:
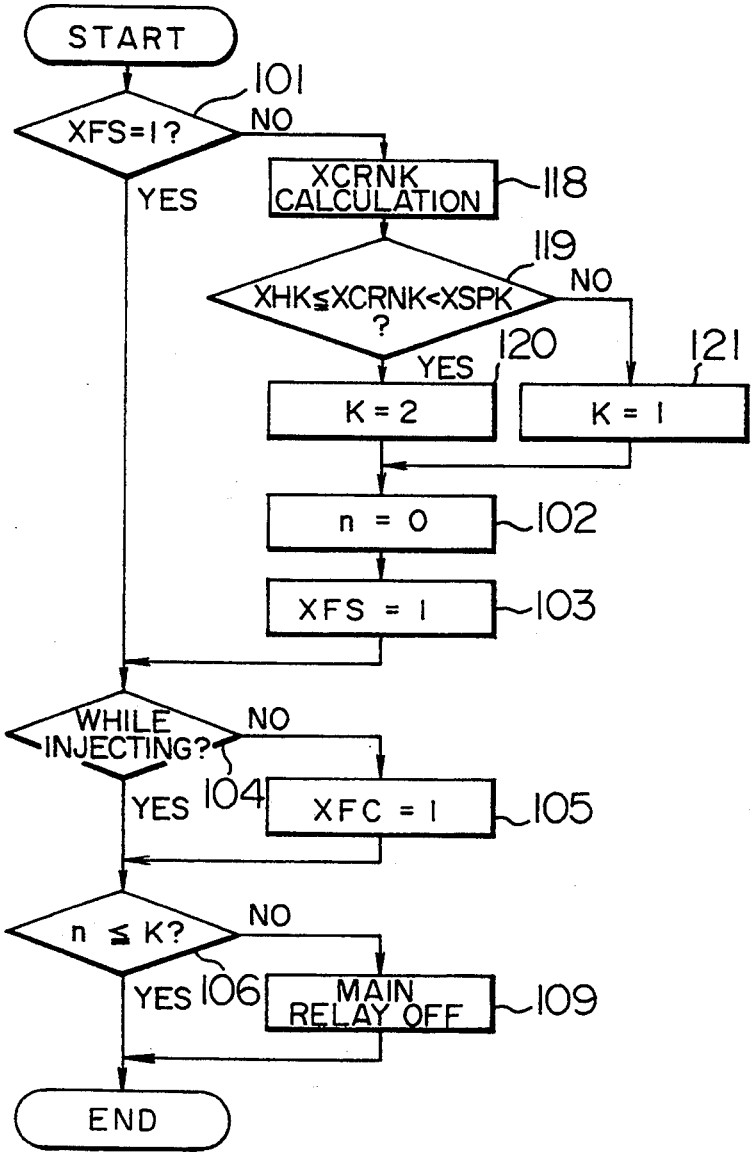
FIG. 6 is a flow chart showing another embodiment of the present invention control of the fuel injection operation and the igniting operation for the injected fuel.

In order to perform the ignition only in the combustion chambers into which which the fuel is already injected when the fuel injector 7 completes injecting the calculated amount of fuel in the combustion engine 100 and a further fuel injection is prevented after detecting that the combustion engine 100 is ordered to to be stopped, a fuel injection and ignition control shown in FIG. 6 to be applied to the combustion engine with four cycle combustion and four combustion chambers is started immediately after the CPU detects that the ignition switch 6 has been opened to order the combustion engine 100 to be stopped, and is repeated at intervals of, for example, approximately 10 milliseconds thereafter. The ignition stop notice flag XFS and the fuel injection preventing flag XFC are set "0" just after the ignition switch 6 is closed to activate the CPU 4.

At the step 101 of the fuel injection and ignition control shown in FIG. 6, whether the ignition stop notice flag XFS is now "1" or not is judged. On the start of the fuel injection and ignition control, the ignition stop notice flag XFS is "0". Therefore, a step 118 is carried out to measure a present angular position XCRNK of the crank shaft. Subsequently, at a step 119, the present angular position XCRNK is compared with a fuel injection start angular position XHK of the crank shaft and an ignition start angular position XSPK of the crank shaft detectable subsequently or prior to the fuel injection start angular position. When the present angular position XCRNK is equal to or more than the fuel injection start angular position XHK and is less than the subsequent ignition start angular position XSPK, at a step 120, a number "k" of the combustion chambers in which the respective ignitions are to be performed after detecting that the ignition switch 6 has been opened to order the combustion engine 100 to be stopped is set "2". When the present angular position XCRNK is less than the fuel injection start angular position XHK and is equal to or more than the prior ignition start angular position XSPK, at a step 121, the number "k" is set "1". After the steps 120 and 121, the step 102 is carried out so that the number "n" of ignition times or combustion chambers in which the respective ignitions are performed after setting the ignition stop notice flag XFS "1" is set "0", and subsequently the step 103 is carried out to set the ignition stop notice flag XFS "1". When the fuel injection and ignition control of FIG. 6 is repeated after the interval, since the ignition stop notice flag XFS is already set "1", the steps 118, 119, 120, 121, 102 and 103 are not carried out.

Subsequently, whether the injector 7 is being injecting the fuel into the engine or not is judged at the step 104. When the injector 7 is not injecting the fuel, the fuel injection preventing flag XFC is set "1" at the step 5. When the injector 7 is injecting the fuel, a step 106' is carried out directly without passing the step 105. The intervals for repeating the fuel injection and ignition control are sufficiently less than the time between the finish of the fuel injection and the subsequent start thereof, so that the fuel injection preventing flag XFC is securely set "1" when the fuel injection and ignition control is carried out again.

A processing operation relative to an injecting condition of the fuel injector 7 as above described may be carried out prior to a processing operation relative to a condition of the ignition stop notice flag XFS as above described.

At the step 106', whether the number "n" is more than the number "k" or not is judged. When the number of ignition times "n" is not more than the number "k", the fuel injection and ignition control is repeated after the interval. When the number of ignition times "n" is more than the number "k", the switch 2a is opened at the step 109 to prevent the electricity from being supplied to the CPU and the fuel injector 7 so that both the fuel injection and ignition are stopped.

Figure 7:
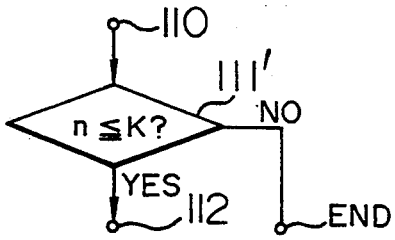
FIG. 7 is a part of flow chart showing a step 11' replacing a step 11 in FIG. 3 when the flow chart of FIG. 6 is used instead of the flow chart of FIG. 2.

When the fuel injection and ignition control of FIG. 6 is used instead of that of FIG. 2, the ignition by each of the spark plugs 11 in the respective combustion chambers is carried out according to another ignition control in which most of the ignition control shown by FIG. 3 other than the step 111 is used and a step 111' shown in FIG. 7 is used instead of the step 111.

Figure 8:
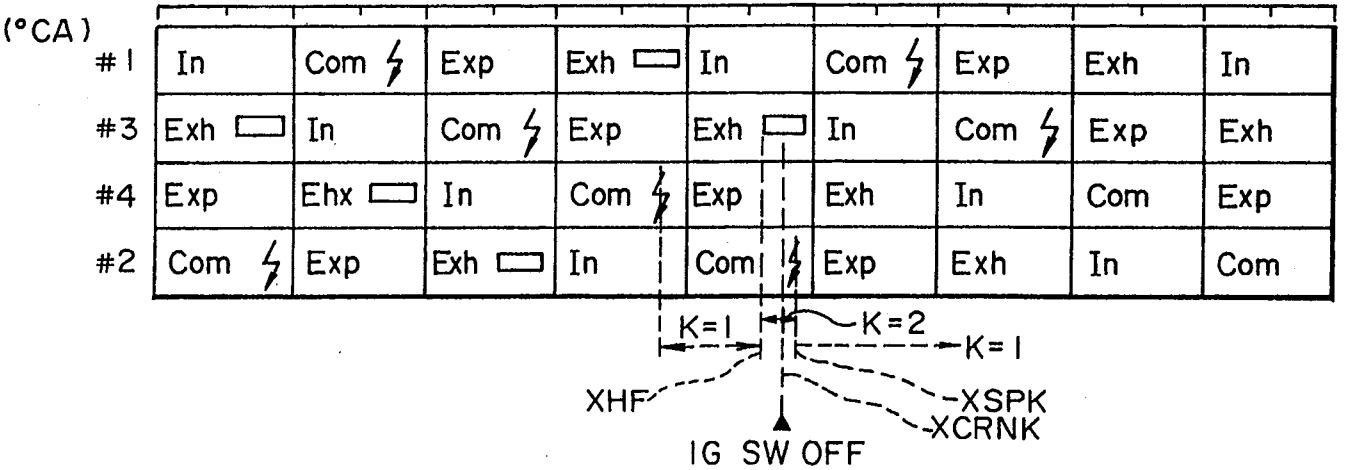
FIG. 8 is a table showing a relation among the fuel injection operation, the igniting operation and combustion cycles proceeding with an engine crank shaft rotation, obtained when the flow chart of FIG. 6 is used.

As shown in FIG. 8, in the present invention's fuel injection and ignition control of FIG. 6 applied to the four-cycle combustion engine with the four combustion chambers, the fuel injector 7 completes securely the calculated amount of fuel regardless of detecting that the ignition switch 6 has been opened to order the combustion engine 100 to be stopped, and the ignitions are performed only in the combustion chambers into which which the fuel is already injected when the fuel injector 7 completes injecting the calculated amount of fuel in the combustion engine 100 and the further fuel injection is prevented after detecting that the combustion engine 100 is ordered to to be stopped the spark plug 11.

Figure 9:
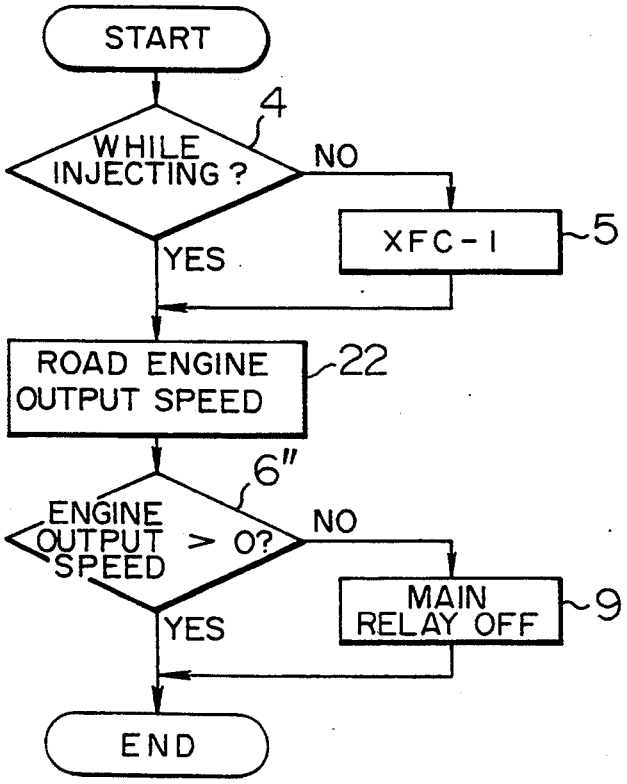
FIG. 9 is a flow chart showing another embodiment of the present invention control of the fuel injection operation.

Alternatively, the spark plugs may be capable of generating the spark or igniting at least until the combustion engine 100 is substantially stopped, according to a fuel ignition and ignition control as shown in FIG. 9, in which control the ignition stop notice flag XFS is kept continuously "0" after the CPU 4 is activated by the ignition switch 6 so that the ignition is not prevented.

The fuel injection and ignition control shown in FIG. 9 is started immediately after the CPU detects that the ignition switch 6 has been opened to order the combustion engine 100 to be stopped, and is repeated at intervals of, for example, approximately 10 milliseconds thereafter. The ignition stop notice flag XFS and the fuel injection preventing flag XFC are set "0" just after the ignition switch 6 is closed to activate the CPU 4.

Whether the injector 7 is being injecting the fuel into the engine or not is judged at the step 104. When the injector 7 is not injecting the fuel, the fuel injection preventing flag XFC is set "1" at the step 105. When the injector 7 is injecting the fuel, a step 122 is carried out directly without passing the step 105 so that a present rotational speed of the crank shaft is measured. Subsequently, at a step 106", whether the present rotational speed of the crank shaft is substantially zero or not is judged. When the present rotational speed of the crank shaft is not substantially zero, the fuel injection and ignition control shown in FIG. 9 is repeated after the interval. When the present rotational speed of the crank shaft is substantially zero, the switch 2a is opened at the step 109 to prevent the electricity from being supplied to the CPU and the fuel injector 7 so that both the fuel injection and ignition are stopped.

What is claimed is:

1. A combustion engine comprising, a determining means for determining an amount of fuel suitable for each combustion cycle in the combustion engine, a fuel injecting means for injecting the fuel into the combustion engine, an ignition means for generating a spark for igniting the injected fuel in the combustion engine, and a detecting means for detecting that the combustion engine is ordered to be stopped, wherein the fuel injecting means prevents the fuel from starting to be injected therefrom into the combustion engine after the detecting means detects that the combustion engine is ordered to be stopped, and, after the fuel injecting means starts to inject the fuel, the fuel injecting means completes injecting the determined amount of fuel into the combustion engine regardless of whether the detecting means detects that the combustion engine is ordered to be stopped.

2. A combustion engine according to claim 1, wherein the determined amount of fuel suitable for each combustion cycle is substantially equal to a lower limit amount of fuel for forming an ultimate lean fuel/air mixture for preventing a misfire in the combustion cycle.

3. A combustion engine according to claim 1, wherein the determined amount of fuel suitable for each combustion cycle is more than a lower limit amount of fuel for forming an ultimate lean fuel/air mixture for preventing a misfire in the combustion cycle.

4. A combustion engine according to claim 1, wherein the determined amount of fuel suitable for each combustion cycle is substantially equal to an optimum amount of fuel for forming a fuel/air mixture to perform a desirable combustion in the combustion cycle.

5. A combustion engine according to claim 1, wherein the amount of fuel suitable for each combustion cycle is determined before the fuel injecting means starts to inject the fuel.

6. A combustion engine according to claim 1, wherein the amount of fuel suitable for each combustion cycle is determined while the fuel injecting means is injecting the fuel.

7. A combustion engine according to claim 1, wherein the fuel injecting means injects a further amount of fuel into the combustion engine in addition to the determined amount of fuel into the combustion engine, when the determined amount of fuel is substantially equal to a lower limit amount of fuel for forming an ultimate lean fuel/air mixture for preventing a misfire.

8. A combustion engine according to claim 1, wherein the fuel injecting means injects a further amount of fuel into the combustion engine in addition to the determined amount of fuel into the combustion engine, when the determined amount of fuel is significantly less than an upper limit amount of fuel for forming an ultimate rich fuel/air mixture for preventing a misfire.

9. A combustion engine according to claim 1, wherein the fuel injecting means prevents the fuel from being injected therefrom into the combustion engine, in response to that the fuel injecting means completes injecting the determined amount of fuel into the combustion engine.

10. A combustion engine according to claim 1, wherein the fuel injecting means prevents the fuel from being injected therefrom into the combustion engine, in response to that the fuel injecting means completes injecting the determined amount of fuel into the combustion engine after the detecting means detects that the combustion engine is ordered to be stopped.

11. A combustion engine according to claim 1, wherein the ignition means is capable of generating the spark in the combustion engine, at least until the fuel finally injected into the combustion engine is ignited by the spark.

12. A combustion engine according to claim 1, wherein the ignition means is capable of generating the spark in the combustion engine, at least until a predetermined time elapses after the detecting means detects that the combustion engine is ordered to be stopped.

13. A combustion engine according to claim 1, wherein the ignition means is capable of generating the spark in the combustion engine, at least until the combustion engine is substantially stopped.

14. A combustion engine control method comprises, the steps of:

determining an amount of fuel suitable for each combustion cycle in the combustion engine, injecting the fuel into the combustion engine, generating a spark for igniting the injected fuel in the combustion engine, detecting that the combustion engine is ordered to be stopped, and stopping the combustion engine by preventing to start injecting the fuel into the combustion engine after detecting that the combustion engine is ordered to be stopped, wherein, after the fuel starts to be injected into the combustion engine, the determined amount of fuel completes being injected into the combustion engine regardless of whether it is detected that the combustion engine is ordered to be stopped.

15. A method according to claim 14, wherein the determined amount of fuel suitable for each combustion cycle is substantially equal to a lower limit amount of fuel for forming an ultimate lean fuel/air mixture for preventing a misfire in the combustion cycle.

16. A method according to claim 14, wherein the determined amount of fuel suitable for each combustion cycle is more than a lower limit amount of fuel for forming an ultimate lean fuel/air mixture for preventing a misfire in the combustion cycle.

17. A method according to claim 14, wherein the determined amount of fuel suitable for each combustion cycle is substantially equal to an optimum amount of fuel for forming a fuel/air mixture to perform a desirable combustion in the combustion cycle.

18. A method according to claim 14, wherein the amount of fuel suitable for each combustion cycle is determined before the fuel starts to be injected into the combustion engine.

19. A method according to claim 14, wherein the amount of fuel suitable for each combustion cycle is determined while the fuel is being injected into the combustion engine.

20. A method according to claim 14, wherein a further amount of fuel is injected into the combustion engine in addition to the determined amount of fuel into the combustion engine, when the determined amount of fuel is substantially equal to a lower limit amount of fuel for forming an ultimate lean fuel/air mixture for preventing a misfire.

21. A method according to claim 14, wherein a further amount of fuel is injected into the combustion engine in addition to the determined amount of fuel into the combustion engine, when the determined amount of fuel is significantly less than an upper limit amount of fuel for forming an ultimate rich fuel/air mixture for preventing a misfire.

22. A method according to claim 14, wherein the fuel is prevented from being injected into the combustion engine, in response to that the determined amount of fuel completes being injected into the combustion engine.

23. A method according to claim 14, wherein the fuel is prevented from being injected into the combustion engine, in response to that the determined amount of fuel completes being injected into the combustion engine after detecting that the combustion engine is ordered to be stopped.

24. A method according to claim 14, wherein the spark is allowed to be generated in the combustion engine, at least until the fuel finally injected into the combustion engine is ignited by the spark.

25. A method according to claim 14, wherein the spark is allowed to be generated in the combustion engine, at least until a predetermined time elapses after detecting that the combustion engine is ordered to be stopped.

26. A method according to claim 14, wherein the spark is allowed to be generated in the combustion engine, at least until the combustion engine is substantially stopped.

* * * * *